US006096492A

United States Patent [19]

Weber et al.

[11] Patent Number: 6,096,492

[45] Date of Patent: Aug. 1, 2000

[54] COLOR PHOTOGRAPHIC MATERIAL

[75] Inventors: Beate Weber, Leichlingen; Markus Geiger, Langenfeld; Jörg Hagemann, Köln, all of Germany

[73] Assignee: Agfa-Gevaert NV, Belgium

[21] Appl. No.: 09/185,774

[22] Filed: Nov. 4, 1998

[30] Foreign Application Priority Data

Nov. 12, 1997 [DE] Germany ..... 197 50 086

[51] Int. Cl.[7] ..... G03C 1/08

[52] U.S. Cl. ..... 430/546; 430/551; 430/558; 430/631; 430/531

[58] Field of Search ..... 430/546, 551, 430/372, 558, 527, 531, 534, 535, 536, 631

[56] References Cited

U.S. PATENT DOCUMENTS

| | | | |
|---|---|---|---|
| 5,104,782 | 4/1992 | Seto et al. | 430/551 |
| 5,804,360 | 9/1998 | Schell et al. | 430/535 |
| 5,846,699 | 12/1998 | Wang et al. | 430/528 |
| 5,876,910 | 9/1998 | Anderson et al. | 430/527 |
| 5,910,401 | 6/1998 | Anderson et al. | 430/533 |

FOREIGN PATENT DOCUMENTS

| | | |
|---|---|---|
| 264 730 | 10/1987 | European Pat. Off. . |
| 273 412 | 12/1987 | European Pat. Off. . |
| 273 712 | 12/1987 | European Pat. Off. . |
| 457 543 | 5/1991 | European Pat. Off. . |
| 486 216 | 11/1991 | European Pat. Off. . |

*Primary Examiner*—Geraldine Letscher
*Attorney, Agent, or Firm*—Connolly Bove Lodge & Hutz LLP

[57] ABSTRACT

A colour photographic material which contains an OH-functional polylactone in at least one layer is distinguished by improved maximum densities.

18 Claims, No Drawings

COLOR PHOTOGRAPHIC MATERIAL

This invention relates to a colour photographic silver halide material having improved maximum density of the image dyes produced on chromogenic development, in particular of the magenta azomethine dyes, which is achieved by combination with certain polymers.

It is known to produce coloured photographic images by chromogenic development, i.e. by developing silver halide emulsion layers exposed with an image by means of suitable chromogenic developer substances, so-called colour developers, in the presence of suitable colour couplers, wherein the oxidation product of the developer substance, which oxidation product is produced congruently with the silver image, reacts with the colour coupler to form a dye image. Aromatic compounds containing primary amino groups, in particular those of the p-phenylenediamine type, are normally used as colour developers.

It is also known that colour couplers may be dispersed in polymers which are insoluble in water and soluble in organic solvents.

DE 4 136 965 proposes, for example, to improve the light stability of dyes by dispersing couplers in polymers soluble in organic solvents. DE 25 35 497 proposes polyester resins obtained from polyhydric alcohols and polybasic carboxylic acids or from oxy acids for this purpose. However, known polymers do not fulfil the requirements placed upon them in every respect. According to JP-N 1 183 650, colour yield and the moisture/heat or darkness/heat stability of dyes may be improved by polymers having an aromatic chain. However, due to inadequate light stability, these polymers have the disadvantage of causing unwanted discolouration of the image whites.

EP 178 974, 264 730, 273 412, 273 712 and 457 543 and U.S. Pat. No. 5,104,782 describe compounds which improve the light stability of photographic image dyes, in particular dyes obtained from pyrazolotriazole couplers.

EP 486 216 describes the use of stabilisers together with polymers which are insoluble in water and soluble in organic solvents.

Prior art measures still fail to achieve adequate light stability at low colour densities and adequate maximum densities. Prior art mixtures moreover have a tendency to crystallise.

The object underlying the invention is to provide polymers suitable as high-boiling solvents which dissolve the couplers and stabilisers, improve maximum density, contribute towards improving the stability of image dyes and do not crystallise.

It has surprisingly now been found that these objects may be achieved with specific OH-functional polylactones.

The present invention accordingly provides a colour photographic material which contains on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler together with conventional non-photosensitive layers, characterised in that at least one layer contains an OH-functional polylactone.

The OH-functional lactone is a polyaddition product of one or more lactones on a low molecular weight polyol.

The OH-functional polylactone is a polymer soluble in organic solvents having an OH value of >20, preferably of >40, and an acid value of <15, preferably of <5, particularly preferably of <2.

The OH-functional polylactone has a (number average) molecular weight of approx. 1000 to 20000, preferably of 1000 to 5000. The polymers used are in particular those which are viscous liquids and accordingly have a Tg of less than 40° C., in particular of less than 10° C.

Suitable examples of OH-functional polylactones according to the invention are

| P | Polyol | Lactone | $M_n$ | OH value mg KOH/g | Acid value |
|---|---|---|---|---|---|
| 1 | 1,2-propylene glycol | ϵ-caprolactone | 2000 | 56 | 1.7 |
| 2 | glycerol | ϵ-caprolactone | 1400 | 180 | 1.3 |
| 3 | trimethylolpropane | ϵ-caprolactone | 1200 | 193 | <1 |

The OH-functional polylactones are in particular used in a quantity of 0.05 to 3 g/g of coupler.

Suitable polyols for the production of the OH-functional polylactones according to the invention are, for example, ethylene glycol, 1,2-propylene glycol, 1,4-butanediol, 1,6-hexanediol, neopentyl glycol, diethylene glycol, glycerol, trimethylolpropane, pentaerythritol.

Suitable lactones for the production of the OH-functional polylactones according to the invention are, for example, ϵ-caprolactone, pivalolactone.

The OH-functional polylactones may be obtained by conventional ring-opening polyaddition of, for example, caprolactone on low molecular weight polyols (cf for example JP 42/92620, U.S. Pat. No. 2,890,208, DE 1 100 947). This is demonstrated by way of example with polymer P-1:

A mixture of 4 g of 1,2-propylene glycol, 96 g of ϵ-caprolactam and 10 mg of dibutyltin oxide is heated to 170° C. for 4 hours.

The layer containing the polymer according to the invention or another layer of the photographic material may contain at least one stabiliser of the formula (I):

(I)

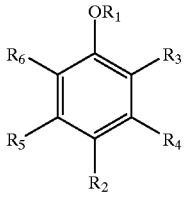

in which $R_1$ means H, alkyl, aryl, acyl;

$R_2$ means —$OR_1$, —COOH, alkyl, aryl, dialkylamino, acylamino, alkylsulfonanido, arylsulfonamido, acyl, alkylsulfonyl or arylsulfonyl;

$R_3$, $R_4$, $R_5$, $R_6$ mean H, halogen or a residue as $R_2$ or two adjacent residues —$OR_1$, $R_2$, $R_3$, $R_4$, $R_5$, $R_6$ may together complete a 5- to 8-membered ring.

An acyl group $R_2$, also as acylamino in this connection, is in particular derived from a carboxylic, carbamic, carbonic or sulfonic acid.

The compounds of the formula (I) are in particular used in a quantity of 0.05 to 3 g/g of coupler.

In further preferred embodiments of the invention, the compound of the formula (I) is in particular of one of the formulae (Ia) to (Ih).

(Ia)

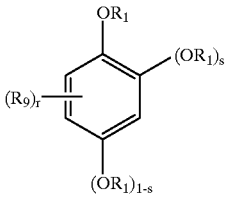

(Ib)

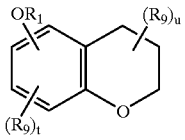

(Ic)

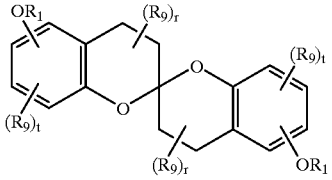

(Id)

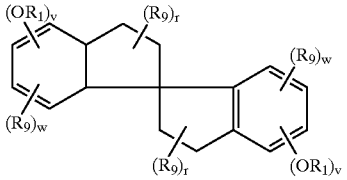

(Ie)

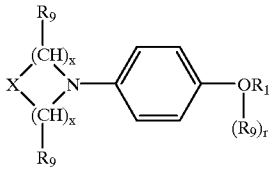

(If)

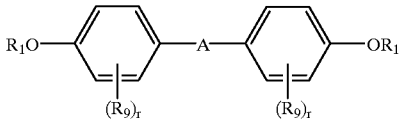

-continued (Ig)

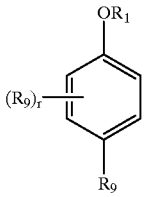

(Ih)

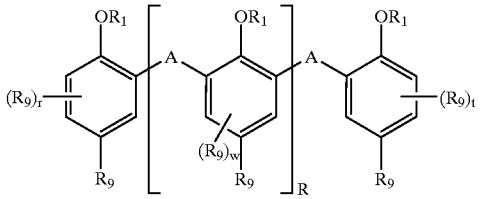

in which

| | |
|---|---|
| $R_9$ | means alkyl, acyl, acylamino, alkylsulfonamido, arylsulfonamido, alkylsulfonyl or arylsulfonyl, |
| A | means a single bond, —CH($R_{10}$)—, —O—, —S—, —$SO_2$—, —$NR_{11}$—, |
| X | means —O—, —S—, —SO—, —$SO_2$—, —N—acyl, —CO—; |
| $R_{10}$ | means H, alkyl, |
| $R_{11}$ | means H, alkyl, acyl, alkylsulfonyl, |
| r | means 0, 1, 2, 3 or 4; |
| s | means 0 or 1; |
| t | means 0, 1, 2 or 3; |
| u | means 0, 1, 2, 3, 4, 5 or 6; |
| v | means 1 or 2; |
| w | means 0, 1 or 2 and |
| x | means 1, 2 or 3. |

Two or more residues $R_9$ or r, t, v, w, x may be identical or different. The conditions described for $R_1$ to $R_6$ apply to the acyl group present in the residue X (formula Ie) and to a possible acyl group in residues $R_9$ and $R_{11}$.

Compounds Ie and Ih are particularly preferred.

Examples of compounds of the formula (I) according to the invention are:

C-1

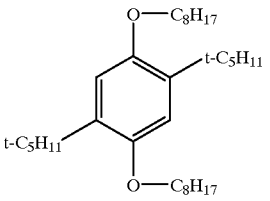

C-2

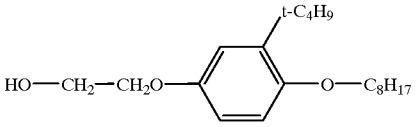

-continued
C-3
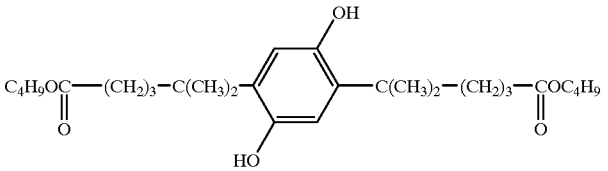
C-4
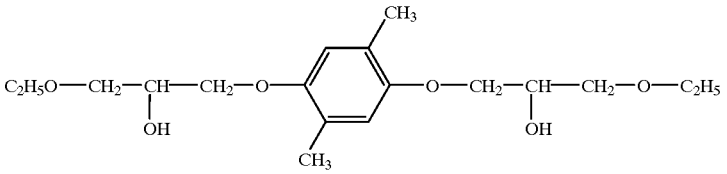
C-5
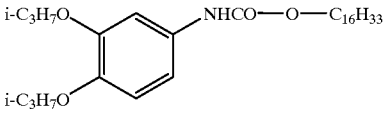
C-6
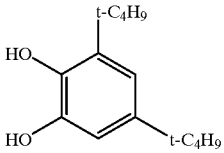
C-7
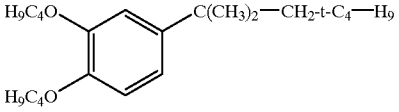
C-8
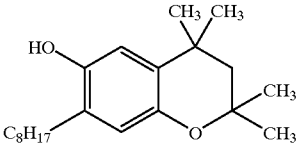
C-9
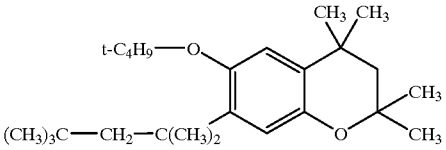
C-10
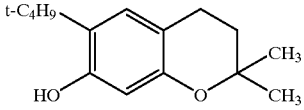
C-11
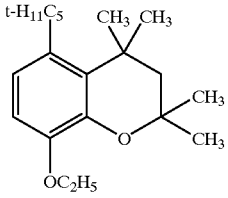

-continued
C-12
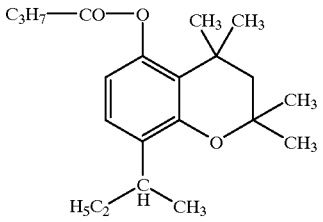
C-13
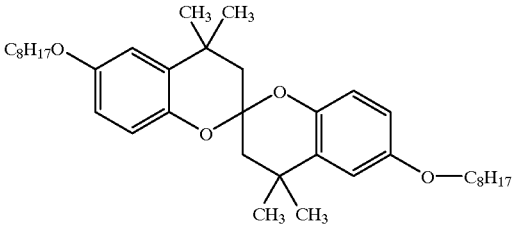
C-14
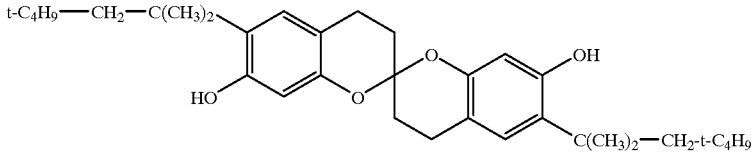
C-15
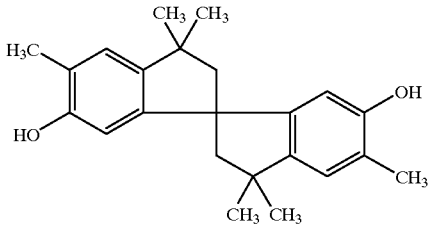
C-16
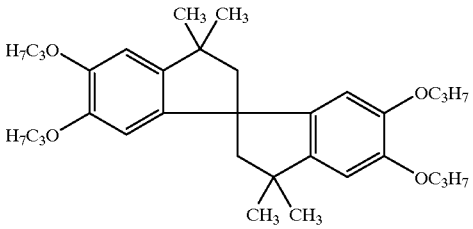
C-17
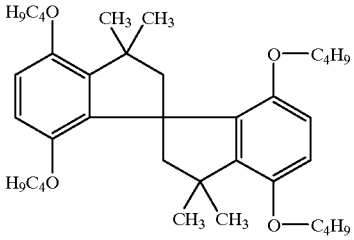
C-18
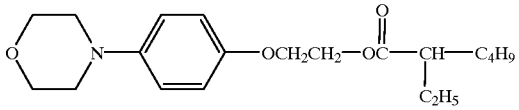

-continued
C-19
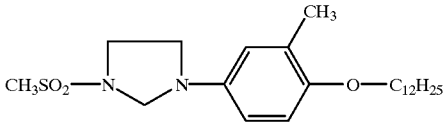
C-20
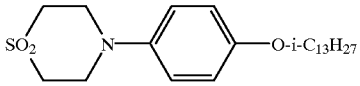
C-21
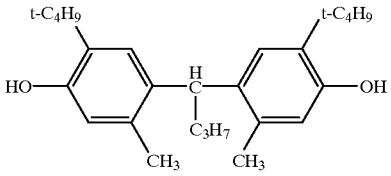
C-22
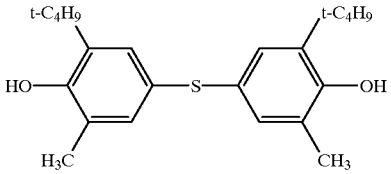
C-23
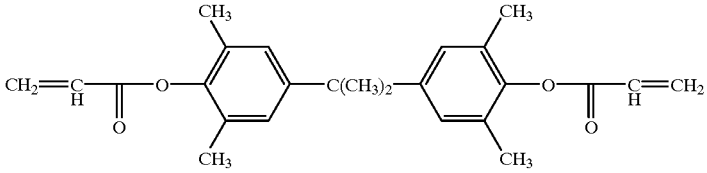
C-24
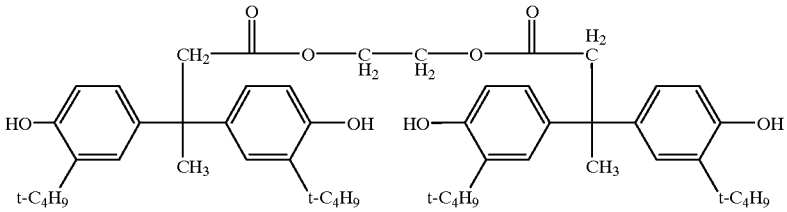
C-25
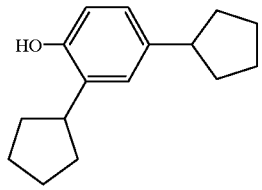
C-26
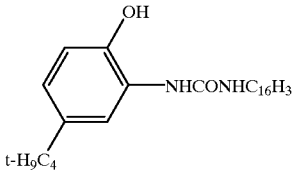

-continued
C-27
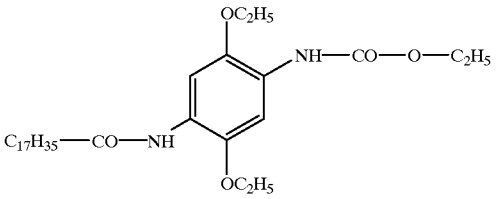
C-28
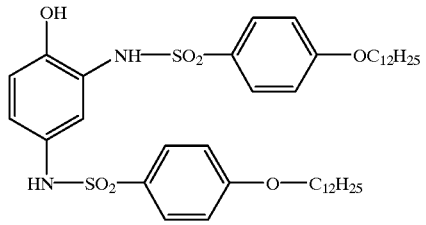
C-29
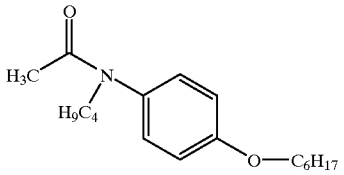
C-30
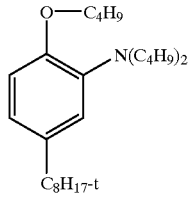
C-31
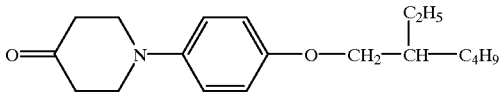
C-32
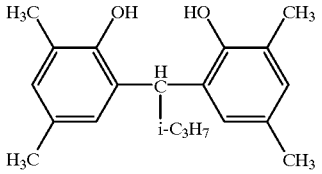
C-33
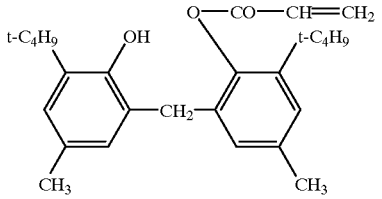

-continued

C-34

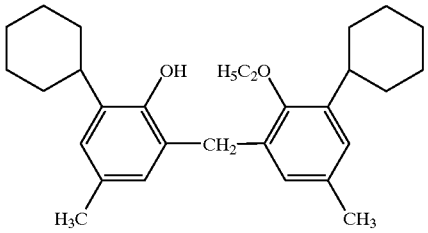

C-35

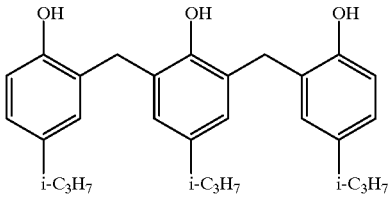

C-36

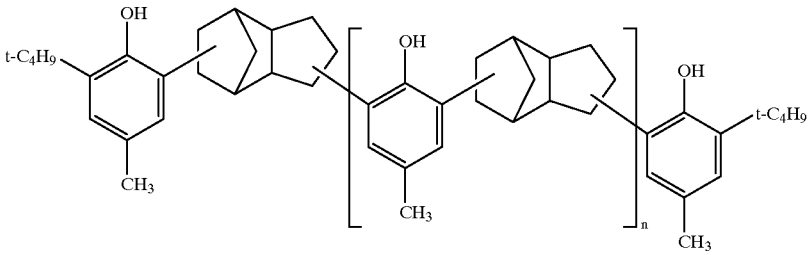

where n=2.5.

The polymers according to the invention may be used in combination with compounds of the formula (II):

$$HO—CH_2—R \quad (II),$$

in which R means alkyl having 9 to 17 C atoms.

The alkyl residue denoted by R may be linear or branched.

In a preferred embodiment of the invention, the residue R has 11 to 15 C atoms.

Examples of compounds of the formula (II) are:

II-1 HO—$C_{12}H_{25}$

II-2 HO—$C_{14}H_{25}$

II-3 HO—$C_{16}H_{33}$

II-4 Exxal 13 (mixture of isomeric, branched, primary $C_{13}$ alcohols) (manufacturer: Exxon)

II-5 Acropol 35 (mixture of linear and isomeric, branched $C_{13}$ and $C_{15}$ alcohols) (manufacturer: Exxon)

II-6 Diadol (mixture of linear and isomeric, branched $C_{13}$ alcohols) (manufacturer: Mitsubishi Kasei)

II-7 Lorol spezial (mixture of linear $C_{12}$–$C_{14}$ alcohols) (manufacturer: Henkel)

II-8

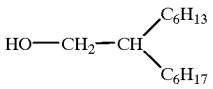

II-9 Lorol techn. (mixture of linear $C_{12}$–$C_{18}$ alcohols) (manufacturer: Henkel)

II-10 HO—$C_{15}H_{31}$.

II-11

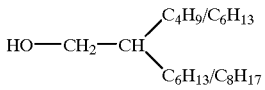

mixture in approx. ratio of 1:1:1:1

II-12

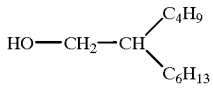

The compounds of the formula II are in particular used in a quantity of 0.05 to 3 g/g of coupler, preferably of 0.1 to 1 g/g of coupler.

In a preferred embodiment, the recording material of the present invention contains compounds of the formula (III) as the magenta coupler (III)

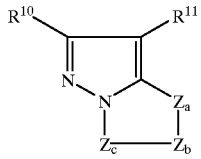

in which $R^{10}$ means H, alkyl, aralkyl, aryl, alkoxy, aroxy, alkylthio, arylthio, amino, anilino, acylamino, cyano, alkoxycarbonyl, alkylcarbamoyl, arylcarbamoyl, alkylsulfamoyl, arylsulfamoyl, wherein these residues may be further substituted, and $R^{11}$ means H or a group which may be liberated by coupling and $Z_a$, $Z_b$, $Z_c$ mean an optionally substituted methine group, =N— or —NH—, wherein either the bond $Z_a$–$Z_b$ or the bond $Z_b$–$Z_c$ is a double bond and the other bond is a single bond.

Couplers of the formula (III) are generally designated pyrazoloazole couplers. These are in particular taken to mean couplers which are derived from imidazolo[1.2-b]pyrazole, imidazolo[3.4-b]pyrazole, pyrazolo[2.3-b]pyrazole, pyrazolo[3.2-c]-1,2,4-triazole, pyrazolo[2.3-b]-1,2,4-triazole, pyrazolo[2.3-c]-1,2,3-triazole or pyrazolo[2.3-d]tetrazole. The corresponding structures are shown below in the formulae IIIa to IIIg.

(IIIa)

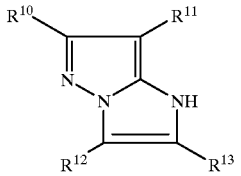

(IIIb)

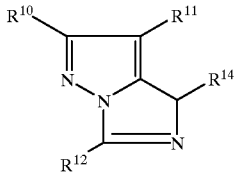

(IIIc)

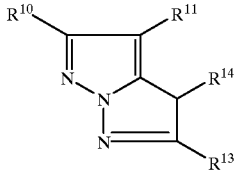

(IIId)

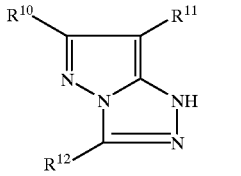

(IIIe)

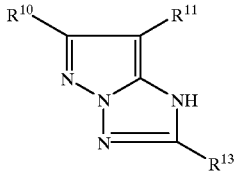

-continued (IIIf)

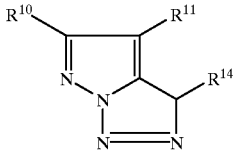

(IIIg)

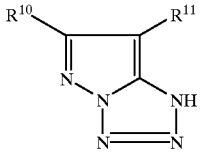

In the general formulae (IIIa) to (IIIg), the residues $R^{10}$, $R^{12}$, $R^{13}$ and $R^{14}$ denote hydrogen, alkyl, aralkyl, aryl, alkoxy, aroxy, alkylthio, arylthio, amino, anilino, acylamino, cyano, alkoxycarbonyl, alkylcarbamoyl, arylcarbamoyl, alkylsulfamoyl, arylsulfamoyl, wherein these residues may be further substituted.

Residues $R^{11}$ eliminable on colour coupling are, for example, a halogen atom or a preferably cyclic group linked to the coupling site via an oxygen atom, a sulfur atom or a nitrogen atom.

If the eliminable group is a cyclic group, the link to the coupling site of the coupler molecule may be achieved either directly via an atom which is a constituent of a ring, for example a nitrogen atom, or indirectly via an intermediate linking member. Numerous such eliminable groups are known, for example as fugitive groups of 2-equivalent magenta couplers.

Examples of eliminable groups linked via oxygen are of the formula $$O—R^{15}$$

in which $R^{15}$ denotes an acyclic or cyclic organic residue, for example alkyl, aryl, a heterocyclic group or acryl, which is derived, for example, from an organic carboxylic or sulfonic acid.

In particularly preferred eliminable groups of this type, $R^{15}$ means an optionally substituted phenyl group.

Examples of eliminable groups linked via oxygen are described in the following German published patent applications: DE-OS 25 36 191, DE-OS 27 03 589, DE-OS 28 13 522, DE-OS 33 39 201.

These groups are often 5-membered heterocyclic rings which are attached via a ring nitrogen atom to the coupling site of the magenta coupler. The heterocyclic rings often contain activating groups, for example carbonyl or sulfonyl groups or double bonds, adjacent to the nitrogen atom which affects the bond to the coupler molecule.

If the eliminable group is attached to the coupling site of the coupler via a sulfur atom, the residue may in this case be a diffusible carbocyclic or heterocyclic mercapto compound which is capable of inhibiting silver halide development. Such inhibitor residues have often been described as the eliminable group attached to the coupling site of couplers, including magenta couplers, for example in U.S. Pat. No. 3,227,554.

Of the pyrazoloazole couplers, those of the formulae (IIId) and (IIIe) are preferred. In the formulae IIId and IIIe, at least one of the residues $R^{10}$ and $R^{13}$ preferably denotes a secondary alkyl or tertiary alkyl residue.

Examples of pyrazoloazole couplers of the formula III are:

III-1
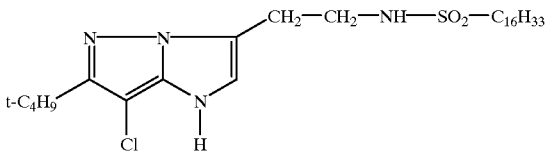
III-2
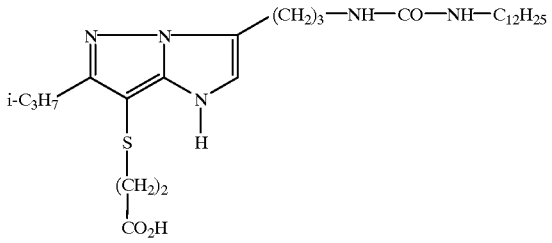
III-3
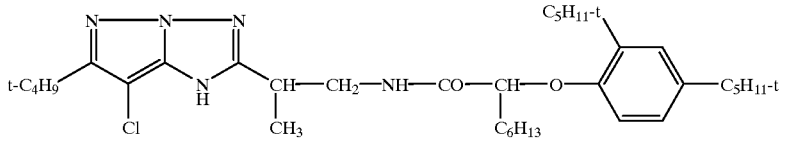
III-4
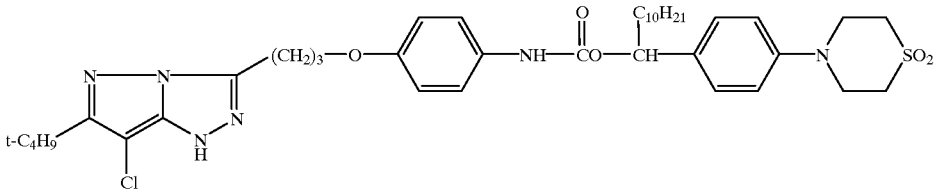
III-5
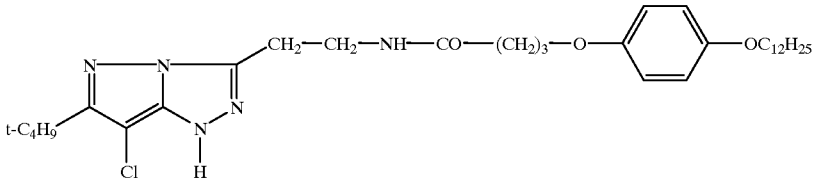
III-6
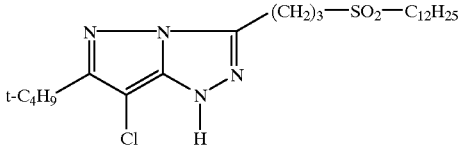
III-7
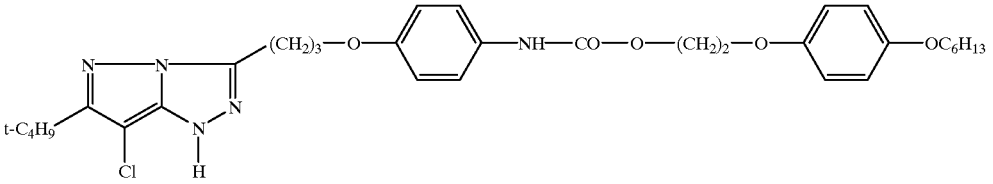
III-8
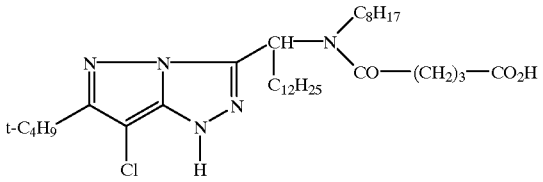
III-9
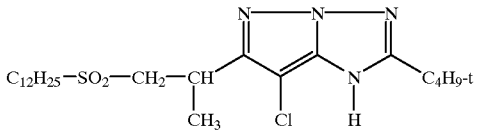

-continued
III-10
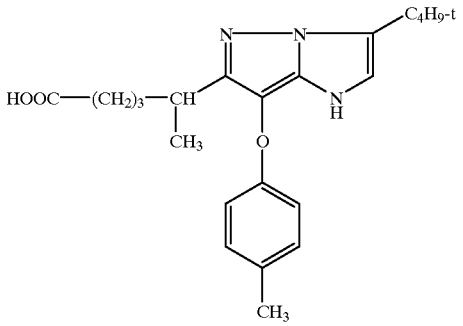
III-11
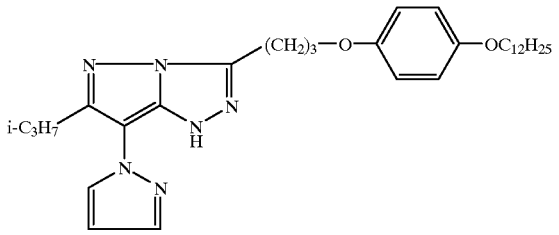
III-12
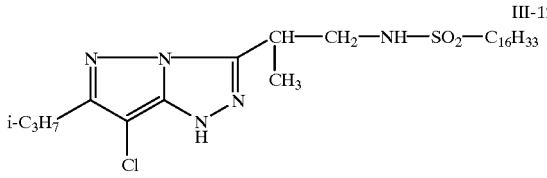
III-13
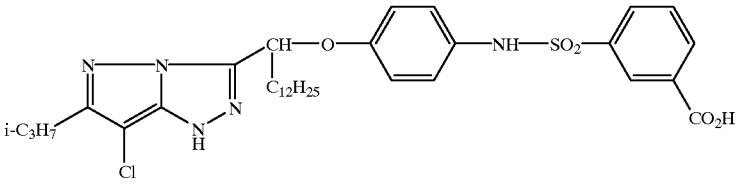
III-14
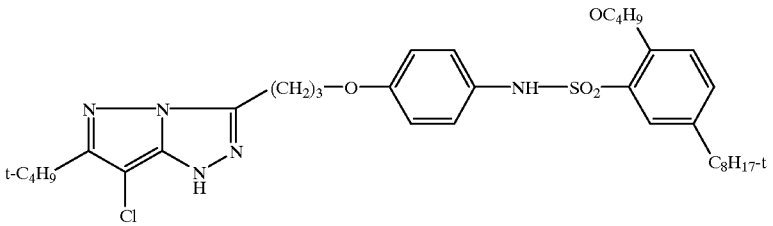
III-15
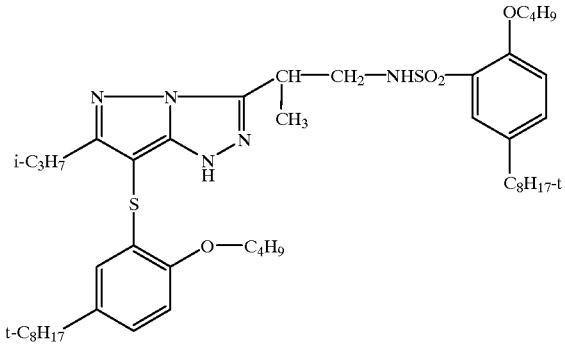

-continued
III-16
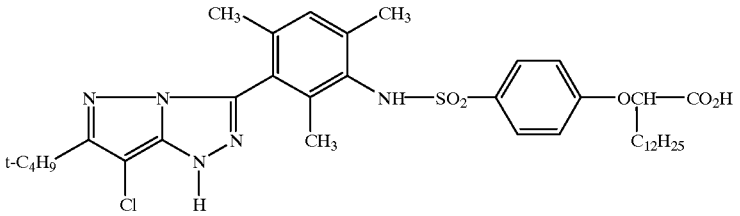
III-17
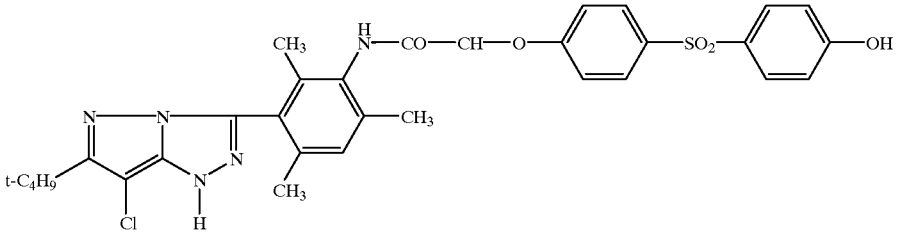
III-18
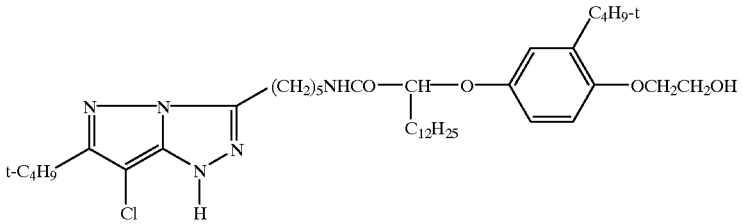
III-19
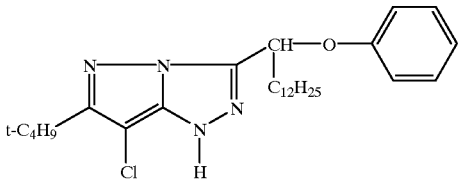
III-20
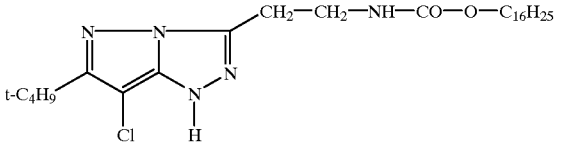
III-21
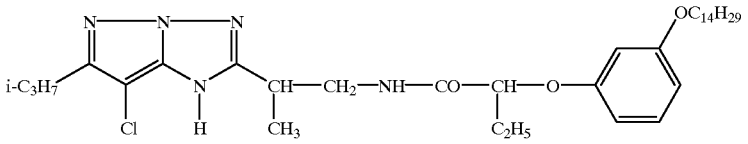
III-22
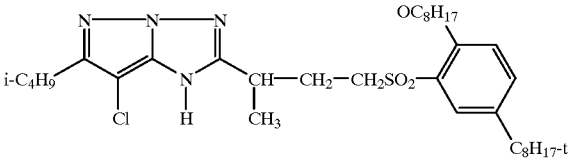
III-23
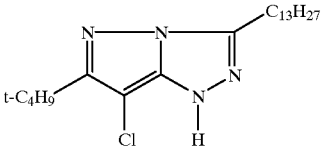
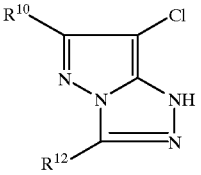
III-24
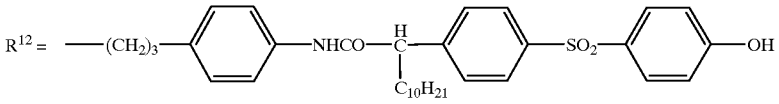
$R^{10} = CH_3$ -continued
III-25
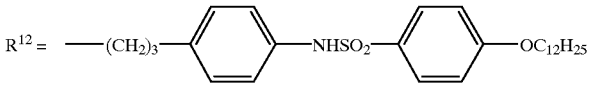
$R^{10} = CH_3$
III-26
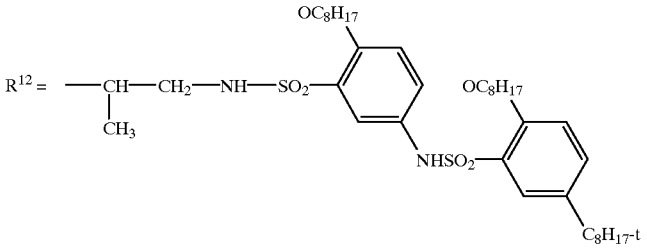
$R^{10} = CH_2—CH(CH_3)_2$
III-27
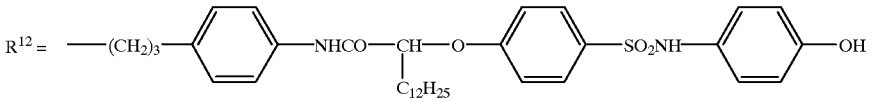
$R^{10} = CH_3$
III-28
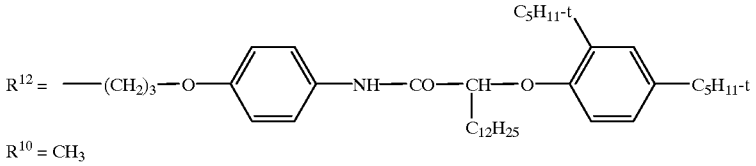
$R^{10} = CH_3$
III-29
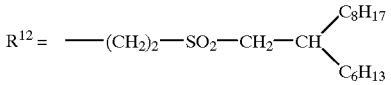
$R^{10} = CH_3$
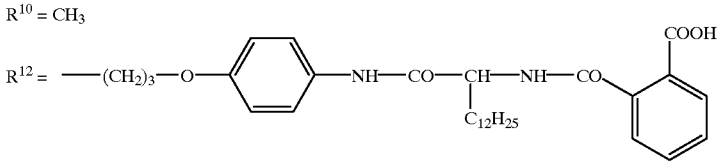
III-30
$R^{10} = CH_3$
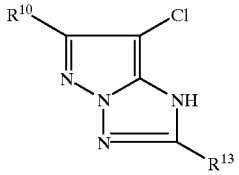

-continued
$R^{13}$ =
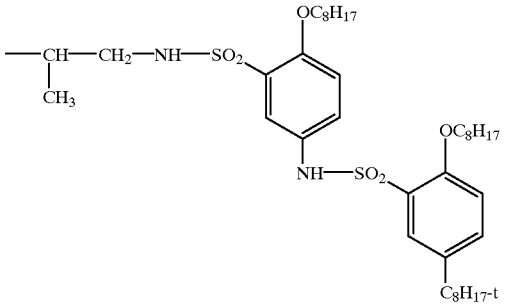
III-31
$R^{10}$ = $CH_3$
$R^{13}$ =
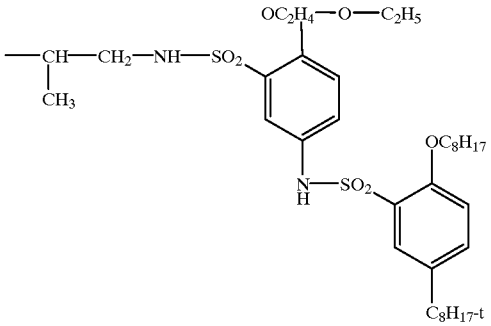
III-32
$R^{10}$ = $CH_3$
$R^{13}$ =
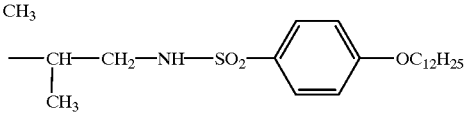
III-33
$R^{10}$ = $—C_3H_7$-n
$R^{13}$ =
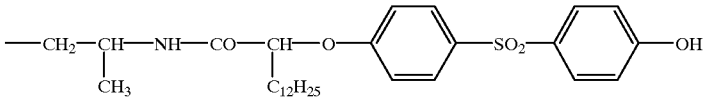
III-34
$R^{10}$ = $CH_3$
III-35
$R^{13}$ = $—CH_2—CH_2—OCH_3—$
$R^{10}$ =
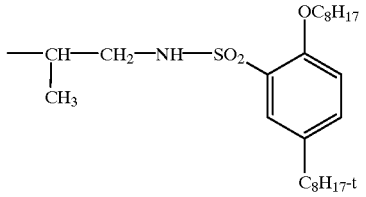
III-36
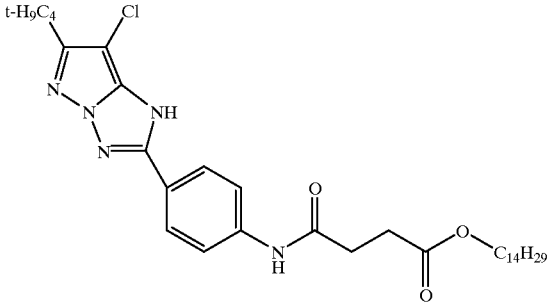
III-37
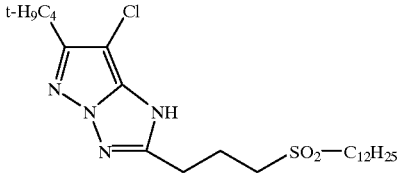

-continued

III-38

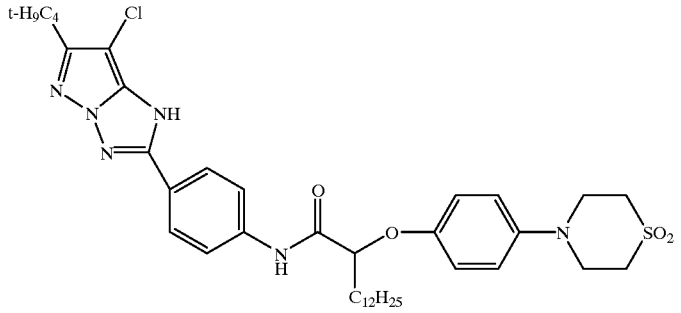

III-39

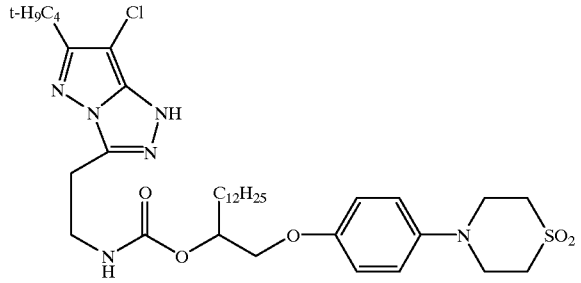

Colour couplers may be 4-equivalent couplers, but they may also be 2-equivalent couplers. The latter are differentiated from 4-equivalent couplers by containing a substituent at the coupling site which is eliminated on coupling. 2-Equivalent couplers are considered to be those which are colourless, as well as those which have an intense intrinsic colour which on colour coupling disappears or is replaced by the colour of the image dye produced (masking couplers), and white couplers which, on reaction with colour developer oxidation products, give rise to substantially colourless products. 2-Equivalent couplers are further considered to be those which contain an eliminable residue at the coupling site, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator. Examples of such 2-equivalent couplers are not only known DIR couplers, but also DAR or FAR couplers.

The couplers used, in particular the pyrazoloazole magenta couplers of the type preferably used according to the invention, for example of the formulae IIId and IIIe, may also be used in polymeric form, for example as a polymer latex.

High molecular weight colour couplers are, for example, described in DE-C-1 297 417, DE-A-24 07 569, DE-A-31 48 125, DE-A-32 17 200, DE-A-33 20 079, DE-A-33 24 93-2, DE-A-33 31 743, DE-A-33 40 376, EP-A-27 284, U.S. Pat. No. 4,080,211.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer is conventionally arranged between the green-sensitive and blue-sensitive layers which prevents blue light from reaching the underlying layers.

Possible options for different layer arrangements and the effects thereof on photographic properties are described in *J. Inf. Rec. Mats.,* 1994, volume 22, pages 183–193 and in *Research Disclosure* 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286, in *Research Disclosure* 37038, part XV (1995), page 89 and in *Research Disclosure* 38957, part VA (1996), page 603.

Photographic materials with camera sensitivity conventionally contain silver bromide-iodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 mm in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD (1996), page 621.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (lattices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLE

A multi-layer colour photographic recording material was produced by applying the following layers in the stated sequence onto a film base of paper coated on both sides with polyethylene. All quantities are stated per 1 $m^2$; the quantity of silver is stated as $AgNO_3$.

Sample 1.1

| | |
|---|---|
| 1st layer: | (Substrate layer) |
| | 0.10 g of gelatine |
| 2nd layer: | (Blue-sensitive layer) |
| | Blue-sensitive silver halide emulsion (99.5 mol. % chloride and 0.5 mol. % bromide, average grain diameter 0.9 mm) prepared from |
| | 0.45 g of $AgNO_3$ and |
| | 1.25 g of gelatine |
| | 0.42 g of yellow coupler Y-1 |
| | 0.18 g of yellow coupler Y-2 |
| | 0.50 g of tricresyl phosphate (TCP) |
| | 0.10 g of stabiliser ST-1 |
| | 0.70 g of blue sensitiser S-1 |
| | 0.30 g of stabiliser ST-2 |
| 3rd layer: | (Interlayer) |
| | 1.10 g of gelatine |
| | 0.06 g of oxform scavenger O-1 |
| | 0.06 g of oxform scavenger O-2 |
| | 0.12 g of TCP |
| 4th layer: | (Green-sensitive layer) |
| | Green-sensitised silver halide emulsion (99.5 mol. % chloride, 0.5 mol. % bromide, average grain diameter 0.47 mm) prepared from |
| | 0.20 g of $AgNO_3$ and |
| | 1.00 g of gelatine |
| | 0.25 g of magenta coupler III-23 |
| | 0.25 g of image stabiliser C-20 |
| | 0.15 g of image stabiliser C-24 |
| | 0.50 g of dibutyl phthalate (DBP) |
| | 0.70 mg of green stabiliser S-2 |
| | 0.50 mg of stabiliser STA |
| 5th layer: | (UV protective layer) |
| | 1.15 g of gelatine |
| | 0.50 g of UV absorber UV-1 |
| | 0.10 g of UV absorber UV-2 |
| | 0.03 g of oxform scavenger O-1 |
| | 0.03 g of oxform scavenger O-2 |
| | 0.35 g of TCP |

-continued

| | |
|---|---|
| 6th layer: | (Red-sensitive layer) |
| | Red-sensitised silver halide emulsion (99.5 mol. % chloride, 0.5 mol. % bromide, average grain diameter 0.5 mm) prepared from 0.30 g of $AgNO_3$ and |
| | 1.00 g of gelatine |
| | 0.42 g of cyan coupler C-1 |
| | 0.42 g of TCP |
| | 0.03 mg of red sensitiser S-2 |
| | 0.60 mg of stabiliser ST-5 |
| 7th layer: | (UV protective layer) |
| | 0.35 g of gelatine |
| | 0.15 g of UV absorber UV-1 |
| | 0.03 g of UV absorber UV-2 |
| | 0.09 g of TCP |
| Layer 8: | (Protective layer) |
| | 0.90 g of gelatine |
| | 0.05 g of optical brightener |
| | 0.07 g of polyvinylpyrrolidone |
| | 1.20 g of silicone oil |
| | 2.50 mg of spacers (polymethyl methacrylate) |
| | 0.30 g of hardener HM-1 |

Sample 1.2

The layer structure was produced in the same manner as sample 1.1, except that polymer P-3 according to the invention is used in the 4th layer instead of DBP.

Sample 1.3

The layer structure was produced in the same manner as sample 1.1, except that the poly-t.-butylacrylamide (PO-1) described in EP 486 216 is used in the 4th layer instead of DBP.

Sample 1.4

The layer structure was produced in the same manner as sample 1.1, except that polyester VP-1 is used in the 4th layer instead of DBP.

Sample 1.5

The layer structure was produced in the same manner as sample 1.1, except that 0.3 g of polymer P-3 and 0.2 g of compound II-8 are used in the 4th layer instead of DBP.

The colour photographic recording materials were exposed through a step wedge, with additional filters being placed in the beam path of the exposure unit such that the wedges appeared neutral at an optical density of D=0.6.

The materials were processed in the following manner in the processing baths shown below:

a) Colour developer - 45 s - 35° C.

| | |
|---|---|
| Triethanolamine | 9.0 g |
| N,N-diethylhydroxylamine | 4.0 g |
| Diethylene glycol | 0.05 g |
| 3-Methyl-4-amino-N-ethyl-N-methanesulfonaminoethyl-aniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-Dihydroxybenzene-3,4,6-trisulfonic acid, trisodium salt | 0.3 g |
| makeup with water to 1000 ml; pH 10.0. | |

b) Bleach/fixing bath - 45 s - 35° C.

| | |
|---|---|
| Ammonium thiosulfate | 75 g/l |
| Sodium hydrogen sulfite | 13.5 g/l |
| Ammonium acetate | 2.0 g/l |
| Ethylenediaminetetraacetic acid (iron/ammonium salt) | 57 g/l |
| Ammonia, 25 wt. % | 9.5 g/l |
| Acetic acid | 9.0 g/l |
| make up with water to 1000 ml; pH 5.5. | |

c) Rinsing - 2 min - 35° C.

d) Drying

After processing in the stated process, the minimum and maximum density in the magenta layer are measured. The processed samples, covered with a UV protection film, were then exposed to light in a xenon tester to determine light fastness ($14.4\times10^6$ l×h).

The results show that usable cast structures are not obtained when stabilisers and known polymers such as PO-1 are used as additives to the magenta emulsion.

TABLE 1

| Sample | $D_{min}$ | $D_{max}$ | Coupler solvent | Percentage loss in density at density 1.0 | 0.6 |
|---|---|---|---|---|---|
| 1.1 comparison | 0.011 | 2.45 | DBP | −23% | −36% |
| 1.2 according to the invention | 0.011 | 2.53 | P-3 | −10% | −15% |
| 1.3 comparison | << | << | PO-1 | << | << |
| 1.4 comparison | 0.011 | 2.42 | VP-1 | −16% | −24% |
| 1.5 according to the invention | 0.011 | 2.59 | P-3/II-8 | −9% | −13% |

<< Cast structure unusable as the dispersion has crystallised.

VP-1: 1,4-butanediol/adipic acid polyester (DE 25 35 497, compound (5) on page 9),

Y-1

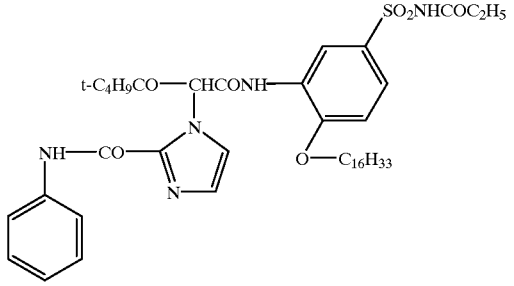

-continued
Y-2
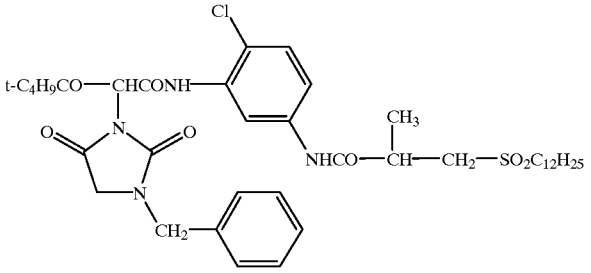
C-1
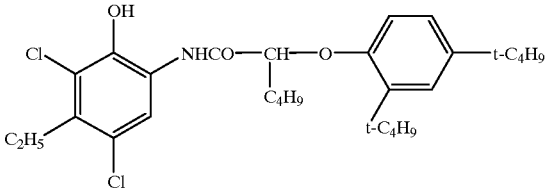
S-1
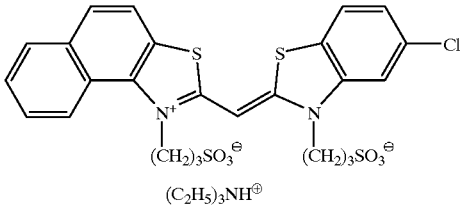
S-2
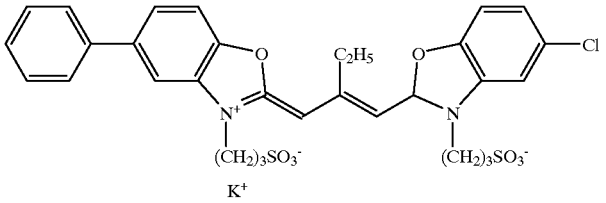
S-3
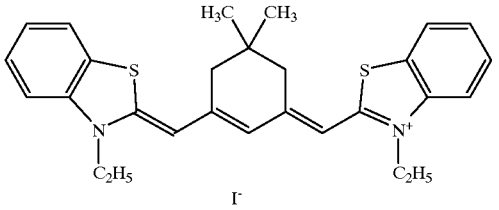
ST-1
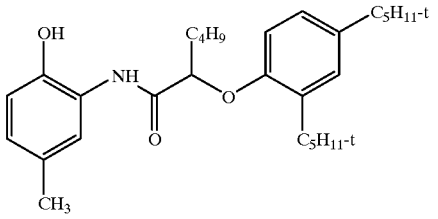
ST-2
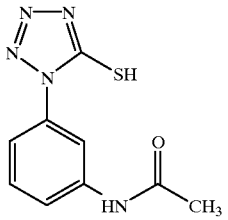
ST-3
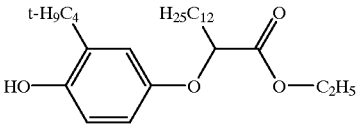
ST-4
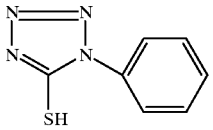
ST-5
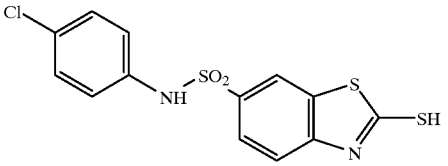

-continued

O-1

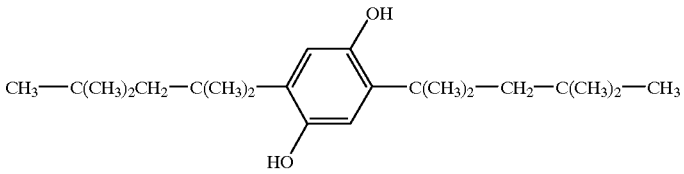

O-2

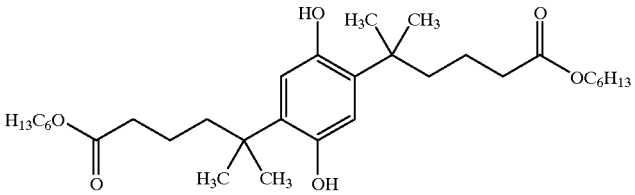

UV-1

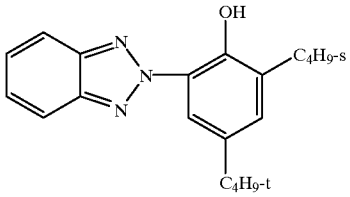

UV-2

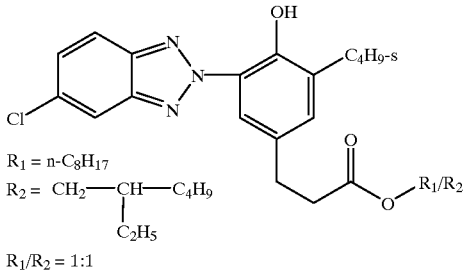

W-1

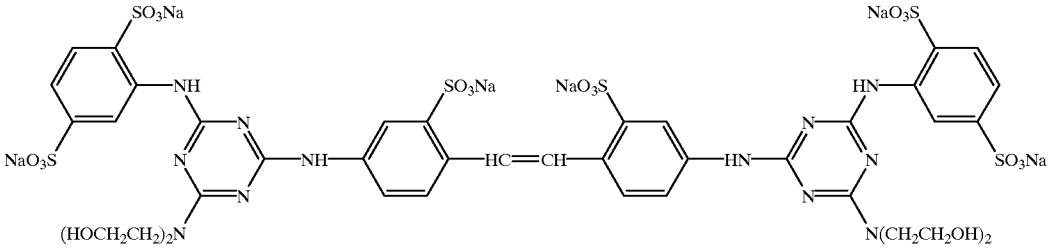

What is claimed is:

1. The color photographic material which comprises on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler together with non-photosensitive layers, wherein at least one layer contains an OH-functional polylactone.

2. The color photographic material according to claim 1, wherein the OH-functional lactone is a polyaddition product of one or more lactones on a low molecular weight polyol, has an OH value of >20 and an acid value of <15 and is soluble in organic solvents.

3. The color photographic material according to claim 1, wherein the OH functional polylactone has a (number average) molecular weight of 1000 to 20000.

4. The color photographic material according to claim 1, wherein one layer contains a stabilizer of the formula I:

(I)

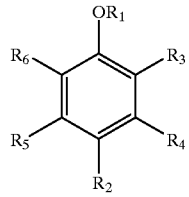

in which $R_1$ is H, alkyl, aryl or acyl;

$R_2$ is —$OR_1$, —COOH, alkyl, aryl, dialkylamino, acylamino, alkylsulfonamido, arylsulfonamido, acyl, alkylsulfonyl or arylsulfonyl;

$R_3$, $R_4$, $R_5$ and $R_6$ are identical or different and are H, halogen or a residue as defined in $R_2$ or two adjacent residues —$OR_1$, $R_2$, $R_3$, $R_4$, $R_5$ and $R_6$ together complete a 5- to 8-membered ring.

5. The color photographic material according to claim 1, wherein a compound of the formula (II) is used together with the OH-functional polylactone:

$$HO—CH_2—R \quad (II),$$

in which R is an alkyl having 9 to 17 C atoms.

6. The color photographic material according to claim 1, wherein the material contains at least one magenta coupler of the formula (III):

(III)

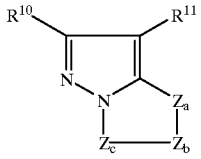

in which $R^{10}$ is H, alkyl, aralkyl, aryl, alkoxy, aroxy, alkylthio, arylthio, amino, anilino, acylamino, cyano, alkoxycarbonyl, alkylcarbamoyl, arylcarbamoyl, alkylsulfamoyl or arylsulfamoyl, wherein these residues may be further substituted, and $R^{11}$ is H or a group which may be liberated by coupling and $Z_a$, $Z_b$ and $Z_c$ are identical or different and are an optionally substituted methine group, =N— or —NH—, wherein either the bond $Z_a$–$Z_b$ or the bond $Z_b$–$Z_c$ is a double bond and the other bond is a single bond.

7. The color photographic material according to claim 6, wherein the magenta coupler of the formula (III) is one of the formulae (IIIa) to (IIIg):

(IIIa)

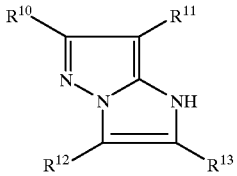

(IIIb)

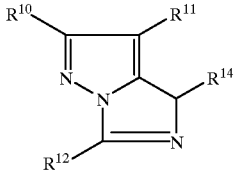

(IIIc)

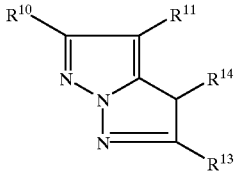

-continued (IIId)

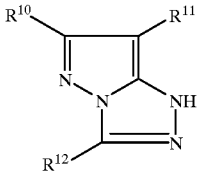

(IIIe)

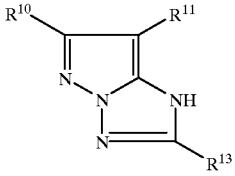

(IIIf)

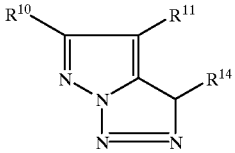

(IIIg)

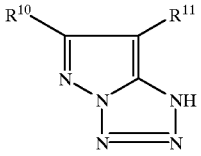

in which $R^{10}$, $R^{12}$, $R^{13}$ and $R^{14}$ are identical or different and are hydrogen, alkyl, aralkyl, aryl, alkoxy, aroxy, alkylthio, arylthio, amino, anilino, acylamino, cyano, alkoxycarbonyl, alkylcarbamoyl, arylcarbamoyl, alkylsulfamoyl or arylsulfamoyl, wherein these residues may be further substituted and $R^{11}$ is a halogen atom or a group linked to the coupling site via an oxygen atom, a sulfur atom or a nitrogen atom.

8. The color photographic material according to claim 4, wherein the stabilizer of the formula (I) is of one of the formulae (Ia) to (Ih):

(Ia)

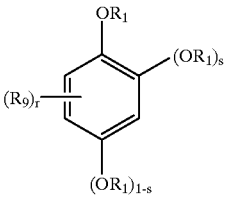

(Ib)

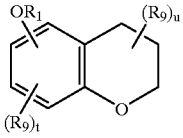

-continued (Ic)

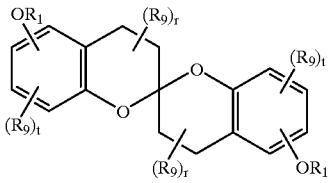

(Id)

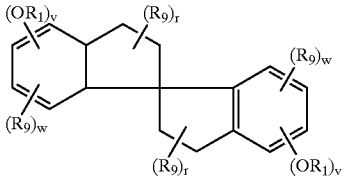

(Ie)

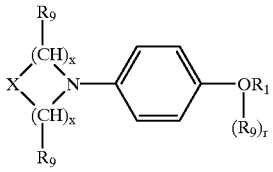

(If)

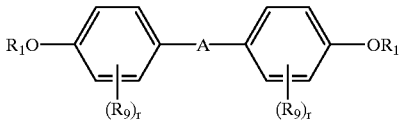

(Ig)

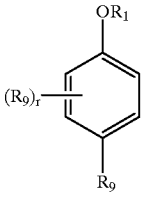

(Ih)

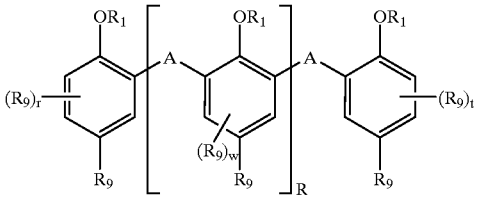

in which

| | | |
|---|---|---|
| $R_9$ | is | alkyl, acyl, acylamino, alkylsulfonamido, arylsulfonamido, alkylsulfonyl or arylsulfonyl, |
| A | is | a single bond, —CH($R_{10}$)—, —O—, —S—, —$SO_2$—or —$NR_{11}$—, |
| X | is | —O—, —S—, —SO—, —$SO_2$—, N—acyl or —CO—, |
| $R_{10}$ | is | H or alkyl, |
| $R_{11}$ | is | H, alkyl, acyl or alkylsulfonyl, |
| r | is | 0, 1, 2, 3 or 4; |
| s | is | 0 or 1; |
| t | is | 0, 1, 2 or 3; |
| u | is | 0, 1, 2, 3, 4, 5 or 6; |
| v | is | 1 or 2; |
| w | is | 0, 1 or 2 and |
| x | is | 1, 2 or 3. |

9. The color photographic material according to claim 1, wherein the OH-functional lactone has an OH value of >40 and an acid value of <5.

10. The color photographic material according to claim 9, wherein the OH-functional lactone has an acid value <2.

11. The color photographic material according to claim 1, wherein the OH functional polylactone has a (number average) molecular weight of 1000 to 5000 and a $T_g$ of less than 40° C.

12. The color photographic recording material according to claim 11, wherein the OH functional polylactone has $T_g$ of less than 10° C.

13. The color photographic material according to claim 4, wherein the stabilizer of formula I is in a quantity of 0.05 to 3 g/g of coupler.

14. The color photographic material according to claim 8, wherein the stabilizer of formula I is of the formula Ie or Ih.

15. The color photographic material according to claim 5, wherein R is an alkyl having 11 to 15 carbon atoms.

16. The color photographic material according to claim 15, wherein the compound of formula II is in a quantity of 0.05 to 3 g/g of coupler.

17. The color photographic material according to claim 16, wherein formula II is present in a quantity of 0.1 to 1 g/g of coupler.

18. The color photographic material according to claim 7, wherein the magenta coupler is of the formula (IIId) or (IIIe) and at least one of the residues $R^{10}$ and $R^{13}$ is a secondary alkyl or tertiary alkyl residue.

* * * * *